United States Patent [19]

Walunga

[11] Patent Number: 4,905,321

[45] Date of Patent: Mar. 6, 1990

[54] COMBINED WORKOUT GLOVE AND WRIST WRAP

[75] Inventor: Allen R. Walunga, Box 55, Stillwater, Minn. 55082

[73] Assignee: Allen R. Walunga, Stillwater, Minn.

[21] Appl. No.: 183,334

[22] Filed: Apr. 7, 1988

Related U.S. Application Data

[63] Continuation of Ser. No. 821,003, May 22, 1986.

[51] Int. Cl.[4] ..... A41D 19/00

[52] U.S. Cl. ..... 2/161 A; 2/160; 2/162

[58] Field of Search ..... 2/161 A, 161 R, 159, 2/162, 163, 160

[56] References Cited

U.S. PATENT DOCUMENTS

| | | | |
|---|---|---|---|
| D. 236,044 | 7/1975 | Carter et al. | 2/161 A X |
| D. 259,955 | 7/1981 | Helferich | 2/161 X |
| 1,716,221 | 6/1929 | Fernie | 2/161 A X |
| 2,710,409 | 6/1955 | Burandt | 2/160 |
| 2,751,598 | 6/1956 | Romeo | 2/161 A |
| 3,707,730 | 1/1973 | Slider | 2/161 A |
| 3,726,525 | 4/1973 | Jackson | 2/161 A X |
| 3,770,270 | 11/1973 | Ingold | 2/161 A X |
| 3,835,472 | 9/1974 | Duggins | 2/161 A |
| 4,138,108 | 2/1979 | Robinson | 2/161 A X |
| 4,198,709 | 4/1980 | Clayton | 2/161 A |
| 4,228,548 | 10/1980 | Cohen | 2/161 A |
| 4,253,660 | 3/1981 | Tiktin | 2/161 A X |
| 4,400,831 | 8/1983 | Rietz | 2/161 A |
| 4,408,358 | 10/1983 | Swan | 2/161 A |
| 4,417,359 | 11/1983 | Johnson | 2/161 A |
| 4,525,877 | 6/1985 | Chong | 2/161 A |
| 4,546,495 | 10/1985 | Castillo | 2/161 A |
| 4,608,720 | 9/1986 | Purin | 2/161 A |
| 4,864,123 | 8/1987 | Fabry | 2/161 A X |

*Primary Examiner*—Werner H. Schroeder
*Assistant Examiner*—Jeanette E. Chapman
*Attorney, Agent, or Firm*—Vidas & Arrett

[57] ABSTRACT

Weight-lifting, power-lifting and work-out wrist wraps that are of two types, attached and detachable, are disclosed which includes a work-out glove with exposed finger sleeves for better grip. The attached wrist wrap allows for the combination of both the work-out glove and wrist wrap, making it unncessary to purchase and use the two separately. The detachable wrist wrap allows for the flexibility of applying on the wrist wrap without outside assistance by buttoning on the wrist wrap to the work-out glove; it also allows for the use of both the work-out glove and wrist wrap separately. Both types of wrist wraps provide protection from injury to the wrist tendons and strengthen the wrists for the lifting of heavy weights.

2 Claims, 1 Drawing Sheet

COMBINED WORKOUT GLOVE AND WRIST WRAP

This is a continuation of copending application Serial No. 821,003 filed on 05-22-86.

BACKGROUND OF THE INVENTION

1. Field of Invention

Weight-lifters, body-builders, power-lifters, and some laborers, such as construction workers, wear specially designed gloves for protection from blisters. Wrist wraps are also worn by the same group of people to protect the wrist tendons from injury due to heavy or excessive weights and to strengthen then when doing work-outs with weights.

2. Description of Prior Art

Previous inventions in the following are cited for their limitations and problems in comparison to the present invetion:

U.S. Pat. No. 4,525,877 is a sports glove for racquet ball sports and not for weight-lifting, bodybuilding and powerlifting. The finger sleeves of the gloves are not exposed, like the way U.S. Pat. No. 4,546,495 invention is shown to have. The attached wrist support band of U.S. Pat. No. 4,525,877 is limited to its use by weight-lifters and others in that it is not long enough. Its difference to the present invention is that it is, also, not detachable. Its construction is mainly for racquet players. Though the wrist support band can be stretched when applying it on, it would not meet the requirements of the weight-lifters and others for the purpose of wrist protection, where stresses placed on the wrist tendons when lifting weights are greater in comparison to simply holding and using a racquet.

The U.S. Pat. No. 4,525,877, as noted above, does not have a detachable wrist wrap or detachable 'wrist support band.'

U.S. Pat. No. 4,408,358 is mainly a cold weather sports glove for fly fishing. Its main components are not for weight-lifting. Its purpose, therefore, are different due to its peculiar construction. The thumbs and index finger sleeve expose are mainly for dexterity in fly fishing. The rest of the finger sleeves are not exposed, as would be required for workout gloves for weightlifters and others. Furthermore, what appears to be a wrist wrap is not a wrist wrap but a feature that seals the hand from cold air and water. It would certainly not serve the purpose of protecting and strengthening the wrist tendons when weightlifting. Its use in weight-lifting would not be practical.

U.S. Pat. No. 4,546,495 is indeed a weight-lifter's glove. Its peculiar feature rests in the insert palm wedge. My invention would not have this inserted palm wedge. While it is similar in its exposed finger sleeves, it lacks the wrist wrap, whether attached or detachable. What appears to be a wrist wrap simply closes the glove but does not provide protection for the wrist and its tendons. It is rather too short to even give adequate wrist protection for heavy weight-lifting.

U.S. Pat. No. 3,770,270 is not obviously a weight-lifter's glove; not all the exposed finger sleeves are there for dexterity and better grip and control when handling heavy weights. What appears to be wrist support or wrist wrap by buttoning will not serve the requirements of weight-lifters. It is a closure and not a wrist-wrap for the purpose of wrist tendon protection. In fact, wearing such a glove in work-outs would cause wrist tendon injuries should heavy weights be lifted.

Thus, previous inventions fail to provide both a workout glove and the flexibility of either an attached or detachable wrist wraps.

SUMMARY

The combined workout glove and wrist wrap (whether attached or detachable type) protects the wrist tendons while serving as a weight-lifter's glove in its feature of exposed finger sleeves for dexterity and better grip and protection of the palm from blisters. The attached wrist wrap, due to its longer length, meets the requirements of weight lifters and others, in that wearing it will give better wrist protection when heavy stress is imposed. There is the convenience of putting on the wrist wraps because the glove acts as a holder of the end of the wrist wrap in order to pull it to the degree desired by the user, something which separate wrist wraps do not have. This is important since during competitions and Olympic meets, time is of essence and independent putting on of wrist wraps is important. Normally, independent wrist wraps are put on with the assistance of another person where the end of wrist wrap is held until the wrist wrap has been wound around. This assistance from another person takes time and causes inconvenience. Furthermore, to prevent stoppage of blood circulation due to continued wearing of wrist wraps, wrist wraps have to be released after doing an exercise requiring wrist protection. The attached wrist wrap would give this convenience of being able to take the wrist wrap off without having to worry about imposing on others to later put it back on again. Generally, separate wrist wraps cause weight lifters to keep the wrist wraps on in order to avoid asking for assistance again in putting them back on. This can cause the danger of prolonged stoppage of blood circulation. This inconvenience is solved by the combined workout glove and wrist wraps. The detachable type of wrist wrap would be buttoned off and on whenever the need for wrist wrap occurs. The advantages are the same as the attached type. The added advantage in the latter is option of wearing either one of the two whenever the need arises. There are some exercises that do not require wrist wraps; in such caess, the wrist wraps can be taken off to keep them from getting in the way by dangling or not feel obligated to put on the wrist wraps on in order to get them out of the way. When the need does arise, they can be conveniently applied on by buttoning them to the workout gloves and wearing them conveniently without the assistance of others.

DETAILED DESCRIPTION OF THE DETAILED EMBODIMENT

Figure 1:
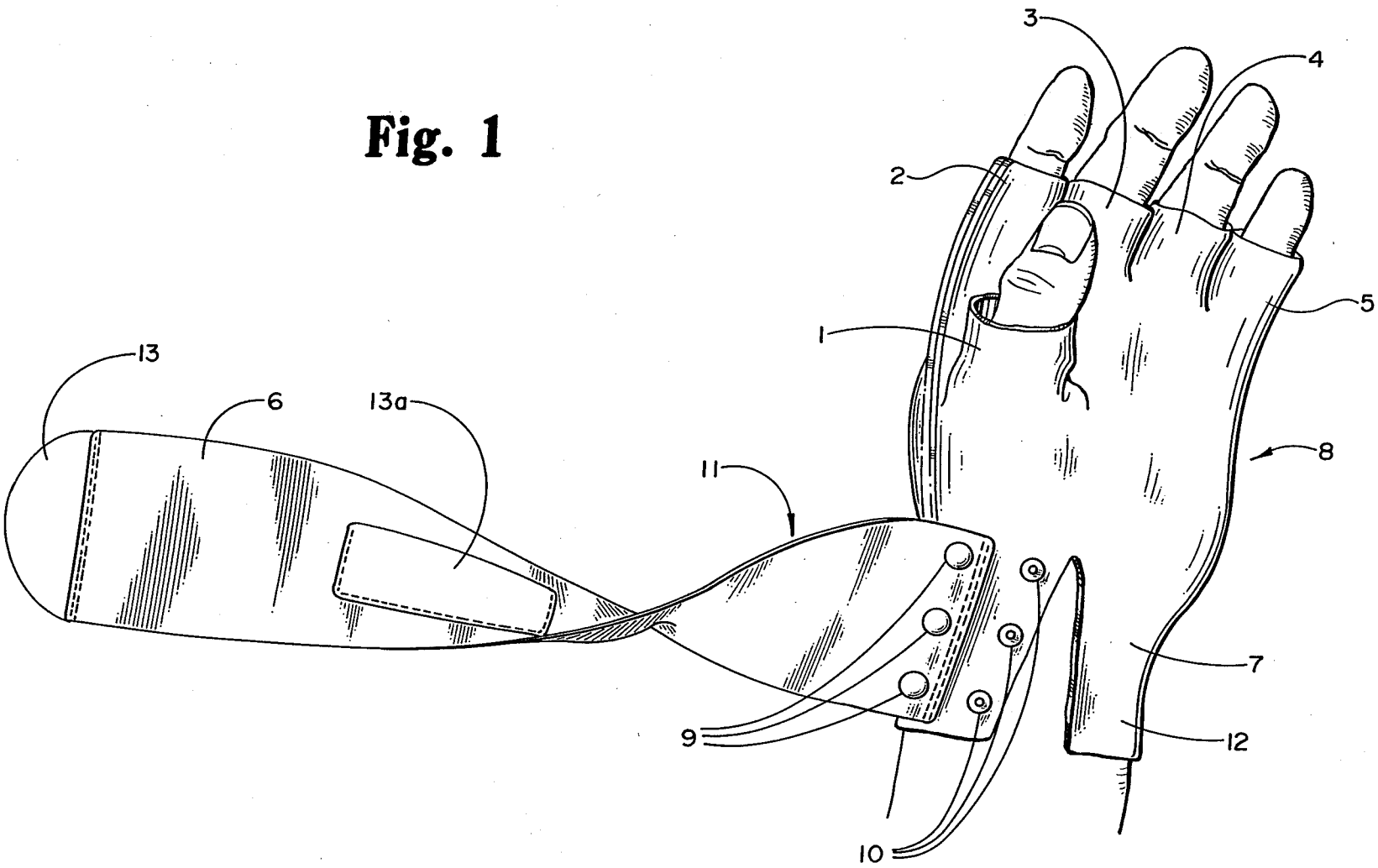
FIG. 1: Detachable Type of Wrist Wrap with Work-out Glove

The Work-out Glove (8) of the present invention is shown in FIG. 1 with Wrist Wrap (11).

The Work-out Glove (8) is made out of leather, while the Wrist Wrap (11) is made out of strong elastic material, with velcro tm on the end of the Wrist Wrap (13) and corresponding on the Wrist Wrap itself (13a).

The Wrist Wrap (11) is shown not buttoned onto the Work-out Glove (8). The snap-buttons (9) and (10) are buttoned on when the Wrist Wrap is being used with the Work-out Glove (8). The Wrist Wrap (11) is snap-buttoned on, wound around the wrist towards reference numerals (7) and (12) and then fastened with Velcro TM fasteners (13) and (13*a*). As shown in FIG. 1, the velcro TM 13*a* is located at a mid-portion of the strap 11.

One portion of the Velcro TM fastener (13*a*) is attached on one side of the free end (6) and the other portion on the opposite side of the Wrist Wrap (11). Although this Wrist Wrap (11) is shown on the left side of the Work-out Glove (8), it is wound around the direction of the wrist (7) of the Work-out Glove (8).

The Work-out Glove (8) of the present invention offers a number of features not present in prior art gloves. First of all, work-out gloves for body-builders, etc., do not have the Wrist Wrap (11) that can be attached and detached with snap buttons (9) and (10). U.S. Pat. No. 4,525,877 of prior art is not a work-out glove in that it does not have exposed finger sleeves as (1), (2), (3), (4) and (5). Furthermore, 4,525,877 invention has additional features on it not in the present invention, such as the one on the palm. The present invention gives the convenience to users to be able to wrap around the Wrist Wrap (11) without the assistance of another person. The Velcro TM fasteners (13) and (13a) will be able to hold the Wrist Wrap (11) after it has been wrapped on. Additional features of the present invention are the snap-buttons (9) and (10) which makes the Work-out Glove (8) usable by itself.

What I claim is:

1. A combined work out glove and wrist strap for protecting the wrist tendons from injury comprising:

a leather glove having a wrist portion and a hand portion, the hand portion having its thumb and finger sleeves open for better gripping and dexterity, and the wrist portion having a plurality of snap-buttons;

a wrist strap having a snap end including a plurality of mating snap-buttons and a self-adhering tape end, wherein the snap end is constructed and arranged to permit engagement of the snap-buttons on said work out glove with the mating snap-buttons on the wrist strap, said wrist strap further including a piece of self-adhering tape positioned at a mid-portion of the strap such that when said wrist strap is wrapped around the wrist the self-adhering tape end will grippingly engage the self-adhering tape piece on the mid-portion of the strap, said strap being made out of an elastic material having a length such that the strap may be wrapped tightly enough about the wrist to impede circulation to the hand, so as to provide support and prevent damage to the wrist tendons during lifting.

2. A method of lifting a load comprising the steps of:

putting on a pair of leather gloves having a wrist portion and a hand portion, the hand portion having its thumb and finger sleeves open for better gripping and dexterity and the wrist portion having a plurality of snaps constructed and arranged to snap to a wrist strap having a snap end and a self-adhering tape end and a rectangular self-adhering tape piece positioned to grippingly engage said self-adhering tape end;

wrapping said strap tightly enough around the wrist to impede circulation to the hand to provide support to the wrist tendons during the lift;

securing said strap with the self-adhering tape end to the rectangular self-adhering tape piece;

lifting the load; and unwrapping the strap to allow circulation to resume.

* * * * *